US005228273A

United States Patent [19]

Kovacs

[11] Patent Number: 5,228,273

[45] Date of Patent: Jul. 20, 1993

[54] METHOD OF AND APPARATUS FOR MAKING PACKAGES

[75] Inventor: Lloyd Kovacs, Sheboygan, Wis.

[73] Assignee: Hayssen Manufacturing Co., Sheboygan, Wis.

[21] Appl. No.: 782,513

[22] Filed: Oct. 25, 1991

Related U.S. Application Data

[63] Continuation of Ser. No. 592,776, Oct. 4, 1990, abandoned.

[51] Int. Cl.[5] ..... B65B 7/04; B65B 51/10

[52] U.S. Cl. ..... 53/479; 53/371.5; 53/371.6; 53/372.4; 493/157; 493/177; 493/182; 493/183

[58] Field of Search ..... 493/157, 182, 183, 177; 53/226, 371.5, 371.6, 371.7, 372.4, 372.5, 377.2, 377.8, 378.3, 450, 491, 547, 479, 550, 461, 463, 464, 465, 466, 207, 224, 232, 233, 376.7, 370.5, 371.3, 566

[56] References Cited

U.S. PATENT DOCUMENTS

| | | | |
|---|---|---|---|
| 1,140,522 | 5/1915 | Mettler . | |
| 1,152,357 | 8/1915 | Reifsnyder et al. . | |
| 2,441,445 | 5/1948 | Ringler et al. | 53/491 X |
| 2,617,240 | 11/1952 | Monaco . | |
| 2,911,779 | 11/1959 | Luczek et al. | 53/372.4 X |
| 3,110,144 | 11/1963 | Johansen et al. | 53/372.4 X |
| 3,201,915 | 8/1965 | Yanulaitis | 53/377.2 |
| 3,225,510 | 12/1965 | Jones et al. | 53/566 X |
| 3,293,827 | 12/1966 | Farnow . | |
| 3,520,103 | 7/1970 | Stevens | 493/157 X |
| 3,818,675 | 6/1974 | Griner . | |
| 4,313,290 | 2/1982 | Furuya et al. . | |
| 4,317,320 | 3/1982 | Nigrelli . | |
| 4,430,844 | 2/1984 | James . | |

FOREIGN PATENT DOCUMENTS 1164311 2/1964 Fed. Rep. of Germany .

*Primary Examiner*—John Sipos
*Assistant Examiner*—Linda B. Johnson
*Attorney, Agent, or Firm*—Senniger, Powers, Leavitt & Roedel

[57] ABSTRACT

A method of and apparatus for the production of packages each comprising a unit of product having opposite ends and a wrapper wrapped around the unit, the wrapper being wider than the length of the unit from end-to-end and initially extending outwardly beyond the ends of the unit, each end of the wrapper being folded over on said end of the product to form four closure flaps overlying said end, a first flap constituting a first side flap, a second flap constituting a first end flap, a third flap constituting a second end flap, and a fourth flap constituting a second side flap, the method of folding over the second end flap, wherein packages are fed forward one after another with the ends of the wrapper extending laterally outwardly at opposite sides of their path of travel, and the second end flaps are folded over at both ends of the package by flexible folding members which are brought into engagement with the trailing side of the trailing portion of each extending end of the wrapper and moved forward at higher speed than the speed of the package.

17 Claims, 11 Drawing Sheets 111
83
81a
81b
77
101
113
107
119
121
105
147
124
123
109
117
162
81a
81b
79
83
115
95
149
53
93

163
F1
F4
95
93
49R
147
101
81a
81b
F3
111
P
151
157
131
71
125
103
81a
81b
83
73
83
83

METHOD OF AND APPARATUS FOR MAKING PACKAGES

This is a continuation of application Ser. No. 592,776, filed Oct. 4, 1990 now abandoned.

BRIEF SUMMARY OF THE INVENTION

This invention relates generally to methods of and apparatus for making packages, and more particularly a method of and apparatus for making packages of the type comprising a roll or rolls of paper, such as a paper towel roll or rolls of toilet tissue in flexible sheet wrapping material such as heat-sealable plastic film.

Reference may be made to the co-assigned U.S. Pat. No. 4,430,844 of Robert C. James, issued Feb. 14, 1984, entitled Method of and Apparatus for Wrapping Articles, disclosing wrapping apparatus of a type sold by the assignee, Hayssen Manufacturing Company of Sheboygan, Wis., under the trademark ULTRA FLOW particularly for packaging toilet tissue rolls and paper towel rolls, for relatively high speed production of packages each comprising one or more rolls enwrapped in flexible sheet wrapping material, such as heat-sealable plastic film (e.g. polyethylene film). As illustrated in that patent, the package produced by that apparatus comprises two rolls disposed side-by-side wrapped in polyethylene film with the wrapper extending outwardly beyond the ends of the rolls. These packages are completed by folding each projecting end of the wrapper over the ends of the rolls to form four closure flaps overlying each end, a first flap constituting a first side flap, which may be referred to as the top flap, a second flap constituting a first end flap, a third flap constituting a second end flap, and a fourth flap constituting a second side flap which may be referred to as the bottom flap, the four flaps at each end of the rolls being heat-sealed together to complete their formation as end closures for the package. This invention has for its object the provision of a method of and apparatus for efficiently folding over the stated second end flap for formation of neat end closures in a high-speed operation and capable of handling packages of rolls of different sizes and different numbers of rolls.

In general, the method of this invention involves continuously feeding packages forward one after another in a predetermined path at a predetermined speed with the packages extending transversely with respect to the direction of feed and with a trailing portion of the extending end of the wrapper extending laterally outwardly at one side of said path, and with the packages spaced at intervals along said path, and, as the packages are so fed forward, bringing a flexible folding member into engagement with the trailing side of said trailing portion of the extending end of the wrapper of each package, and moving said flexible folding member forward in the direction of movement of the package at a higher speed than the speed of the package to fold over said trailing portion on said end of the product to form said second end flap, and then moving said flexible folding member laterally outwardly away from said folder-over second end flap.

In general, apparatus of this invention involves means for continuously feeding packages forward one after another in a predetermined path at a predetermined speed with the packages extending transversely with respect to the direction of feed and with a trailing portion of the extending end of the wrapper extending laterally outwardly at one side of said path, and with the packages spaced at intervals along said path, a flexible folding member for folding over said trailing portion on said end of the product, and means operable as the packages are so fed forward for bringing the flexible folding member into engagement with the trailing side of said trailing portion of the extending end of the wrapper of each package, and moving said flexible folding member forward in the direction of movement of the package at a higher speed than the speed of the package to fold over said trailing portion on said end of the product to form said second end flap, and then moving said flexible folding member laterally outwardly away from said folded-over second end flap.

Other objects and features will be in part apparent and in part pointed out hereinafter.

DETAILED DESCRIPTION

Figure 1:
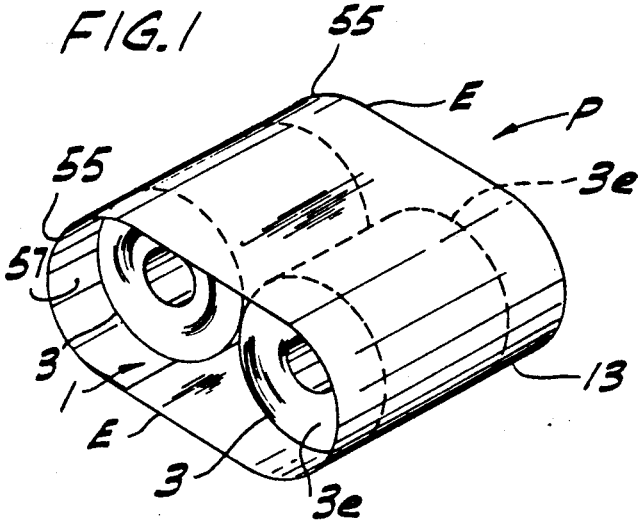
FIG. 1 is a perspective of a package which is to be completed by the method and apparatus of this invention, the package as illustrated comprising two rolls of toilet tissue disposed side-by-side with a wrapper wrapped around the rolls and extending beyond the rolls at each end.
Figure 2:
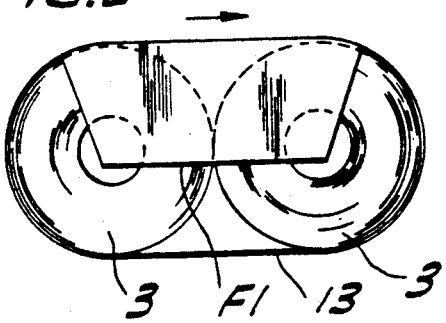
FIG. 2 is an end view showing the respective end of the wrappers folded over on the respective end of the two rolls to form a first side flap (the top flap)
Figure 3:
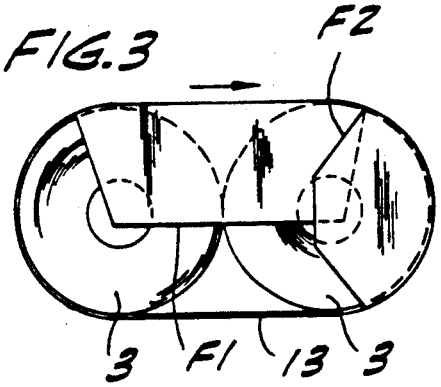
FIG. 3 is an end view showing a successive stage in the completion of the package involving folding over a second flap to constitute a first end flap (the leading end flap)
Figure 4:
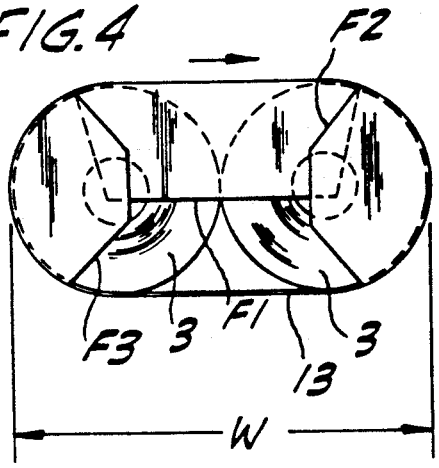
FIG. 4 is an end view showing a further stage in the completion of the package involving folding over a third flap constituting a second end flap (the trailing end flap), this stage being carried out by the method and apparatus of this invention.
Figure 5:
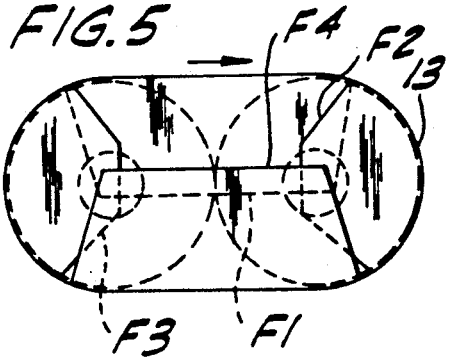
FIG. 5 is an end view showing the folding over of a fourth flap to form a second side flap (the bottom flap)

Referring to the drawings, first more particularly to FIGS. 1-5, there is indicated at P a package comprising a unit of product indicated in its entirety at 1 which is illustrated as a set of two rolls each designated 3 of toilet tissue disposed side-by-side with their axes parallel, and a wrapper 13 wrapped around the product (the two rolls). The wrapper is wider than the length of each roll measured from end-to-end of the roll and initially extends outwardly beyond each end 3*e* of the unit constituted by the two-roll set of rolls. The wrapping is completed by folding over each extending end E of the wrapper on the respective end 3*e* of the unit as packages are continuously fed forward one after another in a predetermined path at a predetermined speed with the packages extending transversely with respect to the direction of feed to form four closure flaps F1-F4, namely a first side flap F1 at the top, a first end flap F2 at one end constituting the leading end of the wrapper, a second end flap F3 at the other end (the trailing end) of the wrapper and a second side flap F4 at the bottom. The top side flap, the leading end flap and the bottom side flap are readily folded over as, for example, by means of stationary plows in conventional manner, portions of the projecting ends of the wrapper engaging the plows as the package is fed forward for folding them over. Alternatively, the top side flap may be blown down by a blast of air. The formation of the trailing end flap F3 presents a problem, however, on account of the forward movement of the package, and this invention involves a method of and apparatus for folding over the trailing end flap for formation of neat end closures in a high speed operation (e.g. 250 packages per minute) capable of handling packages of rolls and different numbers and arrangements of rolls (e.g. the typical single-roll packs, two-roll packs and three-roll packs).

Figure 6:
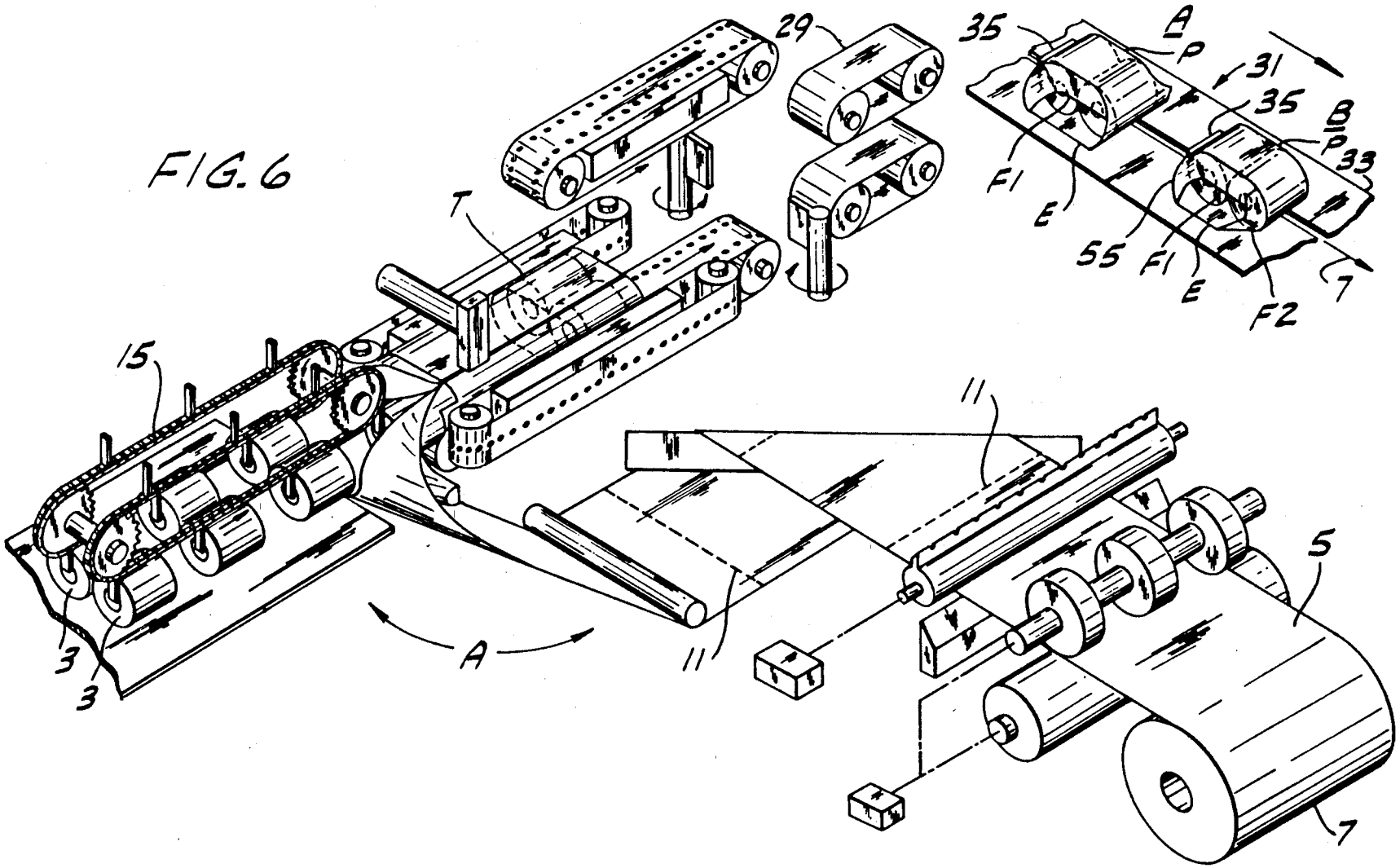
FIG. 6 is a perspective showing apparatus such as may be used to form packages such as shown in FIG. 1 and showing the folding over of the first side flap and the first end flap.

Packages P each having wrapper 13 with its extending ends E may be formed at relatively high speed (e.g. 250 packages per minute) by apparatus such as indicated in its entirety at A in FIG. 6, which apparatus is the same as that disclosed in the above-noted U.S. Pat. No. 4,430,844 of Robert C. James issued Feb. 14, 1984 to Hayssen Manufacturing Company of Sheboygan, Wis., this James patent being incorporated herein by reference. FIG. 6 corresponds to FIG. 1 of said patent, showing web 5 of plastic film, e.g. polyethylene, being pulled from supply roll 7, perforated as indicated at 11 at wrapper length intervals by means 9, formed into tubing T around two-roll units 1 fed forward by means 15, the units being spaced lengthwise of the tubing with the lines of perforations in the spaces between the units, and pulling means 29 for pulling the tubing apart at the lines of perforations to form the packages P.

Each package P as formed by the apparatus A of FIG. 6 (the apparatus of U.S. Pat. No. 4,430,844) is delivered to a flight conveyor generally designated 31 which functions to feed the packages forward one after another in a predetermined path (a horizontal path) with the packages extending transversely with respect to the direction of feed and with the free ends E of the wrapper 13 extending laterally outwardly from the two-roll units 1 therein at opposite sides of said path. As more or less diagrammatically illustrated in FIGS. 1, 2, 6 and 16, the conveyor 31 comprises a slotted table 33 along which packages P are pushed by pushers or flights 35 on an endless chain 37 trained around a rear end sprocket 39 and a forward end sprocket 41 with an upper forward-moving reach 37*a* of the chain 37 just under the table and a lower return reach 37*b* below the upper reach. The pushers or flights 35 are mounted on arms 43 which, along the upper reach of the chain, extend up through the slot 45 in the table 33. The pushers act to push packages P forward along the table, and are spaced a distance greater than the width W of a package. The chain is driven for forward movement of its upper reach generally at a predetermined constant speed by drive means such as indicated at 47 and its operation is so timed in relation to the delivery of packages P by the pulling means 29 of apparatus A that each package is delivered onto the table adjacent the rearward end of the table in front of an oncoming pusher or flight 35, the flights acting to push the packages forward one after another along the table with the packages spaced at intervals corresponding to the flight spacing D, with the wrapper ends E extending laterally outwardly from the roll unit ends 3*e* toward opposite sides of the table.

Figure 7:
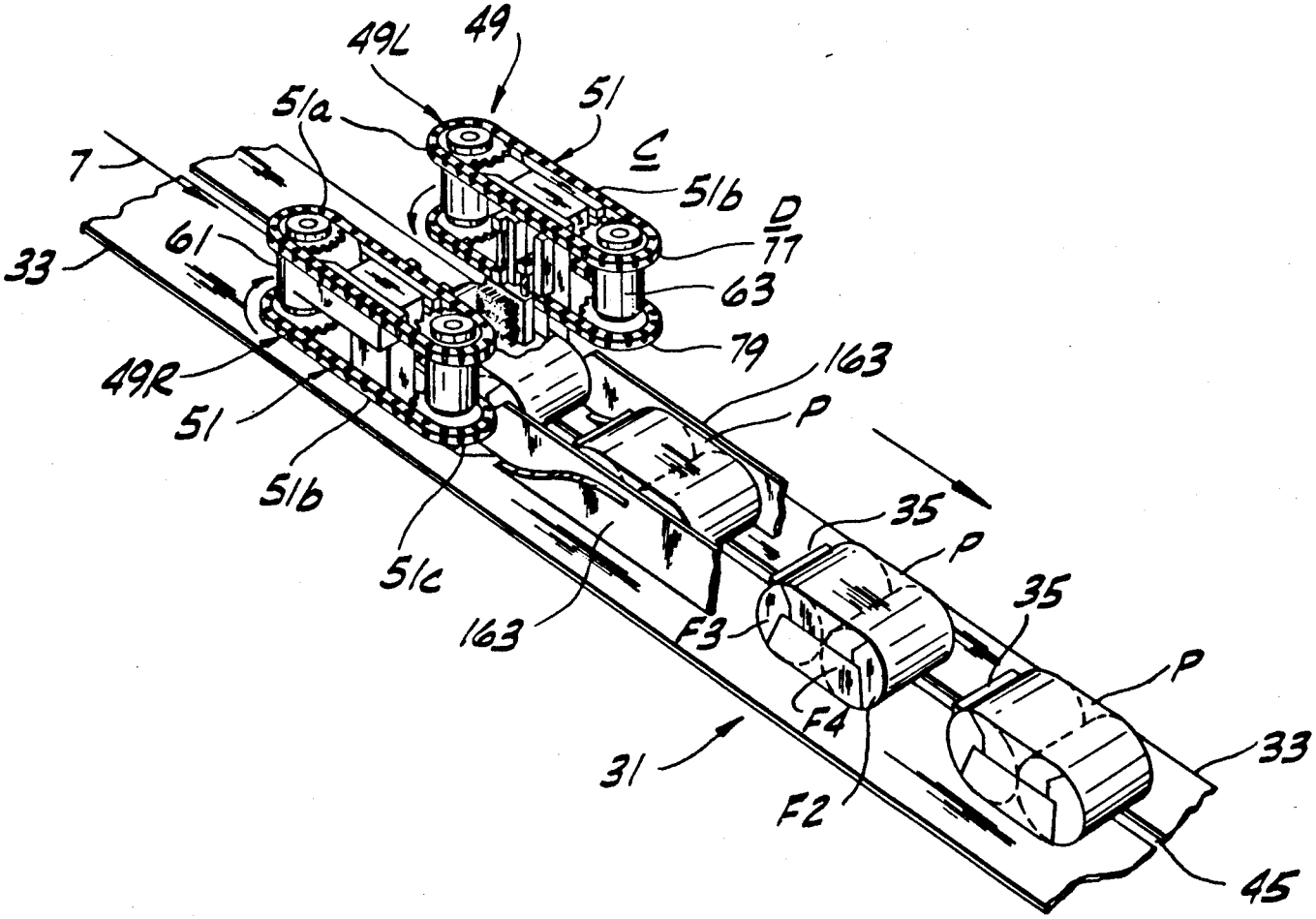
FIG. 7 is a continuation of FIG. 6 as indicated by the arrow at 7 in FIGS. 6 and 7 on a larger scale than FIG. 6 showing apparatus of this invention for folding over the second end flap, are also showing the folding over of the second side flap.

As the package P are fed forward by the conveyor 31, the wrapper ends E first pass through a station A (FIG. 6) where the top flaps F1 are folded over and down at both ends of the package by suitable conventional means (not shown) such as air blast means. They then pass through a station B (FIG. 6) where the leading end flaps F2 (the first end flaps) are folded back at both ends of the package by suitable conventional means (not shown) such as plows, one at each side of the table. They then pass through a station C (FIG. 7) where the trailing end flaps F3 (the second end flaps) are folded forward or tucked over on the ends of the roll unit 1 into position overlying the folded-down top flap by folding or tucking means 49 of this invention, to be described. They then pass through a station D (FIG. 7) where the bottom flaps F4 are folded up into position overlying the first three flaps at both ends of the package by suitable conventional means such as plows, one at each side of the table. Finally, they pass through another station (not shown) where the folded-over flaps F1-F4 are heat-sealed together in conventional and well-known manner, e.g. by heated sealing rollers.

The aforesaid folding or tucking means 49 comprises a left-hand unit 49L for folding or tucking the second (trailing) end flap F3 over on the left end of the package, i.e. folding or tucking it over to lie flat against the previously folded-over top flap F1 on the left end of the package, and a right-hand unit 49R for folding or tucking the second (trailing) end flap F3 over on the right end of the package, i.e. or folding or tucking it over to lie flat against the previously folded over top flap F1 at the right end of the package. Left-hand and right-hand are as viewed in the direction of feed of the packages. The left-hand and right-hand folding or tucking units 49L, 49R are essentially identical (being opposite hand versions of one another), each comprising an endless chain conveyor generally designated 51 at the respective side (the left-hand side or the right-hand side as the case may be) of the path along which the packages P are fed forward by the package conveyor 31 having a forward travelling linear (straight) inner reach 51*a* generally parallel to said path opposed to the respective package end and a rearward travelling linear outer return reach 51*b*. At 51*c* is indicated the forward end reach of the conveyor 51 where it moves around in a semicircular path from the inner reach to the outer return reach, and at 51*d* is indicated the rearward end reach of the conveyor 51 where it moves around in a semicircular path from the outer to the inner reach. As to each of the units 49L, 49R, the endless chain conveyor 51 is constantly driven at a speed somewhat higher than the speed at which the packages P are fed forward by the conveyor 31, and carries a flexible folding member or tucker 53 movable forward at said higher speed along with the inner reach 51*a* of conveyor 51 which comes into engagement with the trailing side 55 of the trailing portion 57 of the respective end E of the wrapper of each package, moves linearly forward relative to the end of the package to fold over or tuck over said trailing portion of the end of the wrapper on the respective end of the set of rolls in the wrapper to form the stated second end flap F3, and then moves laterally outwardly away from the folded-over second end flap.

Figure 8:
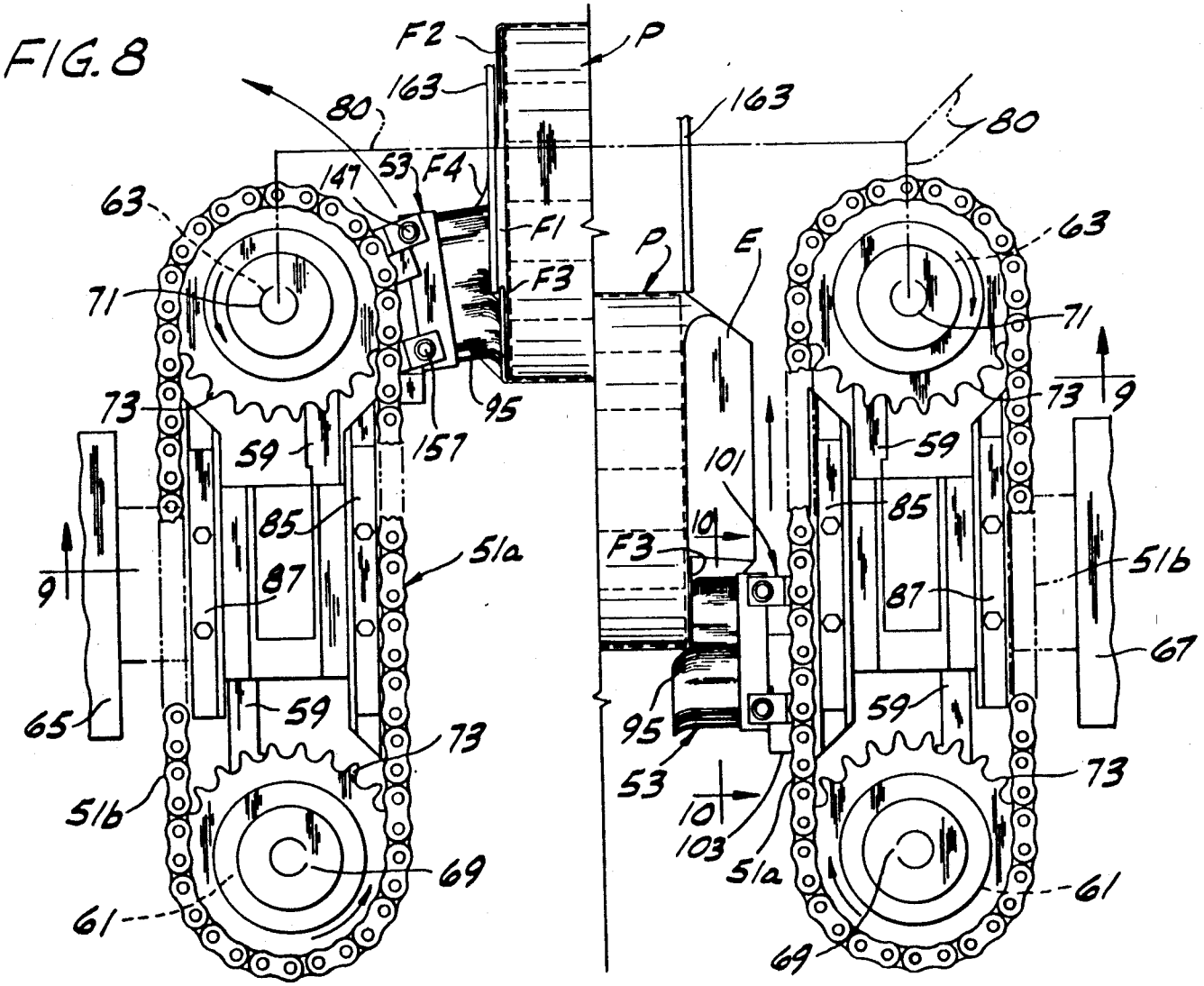
FIG. 8 is a plan of the apparatus shown in FIG. 7 for folding over the second end flap, illustrating the end of the package and the flexible folding member (brush) at the right in a first position, and the, end of the package and the flexible folding member (brush) at the left in a moved position.
Figure 9:
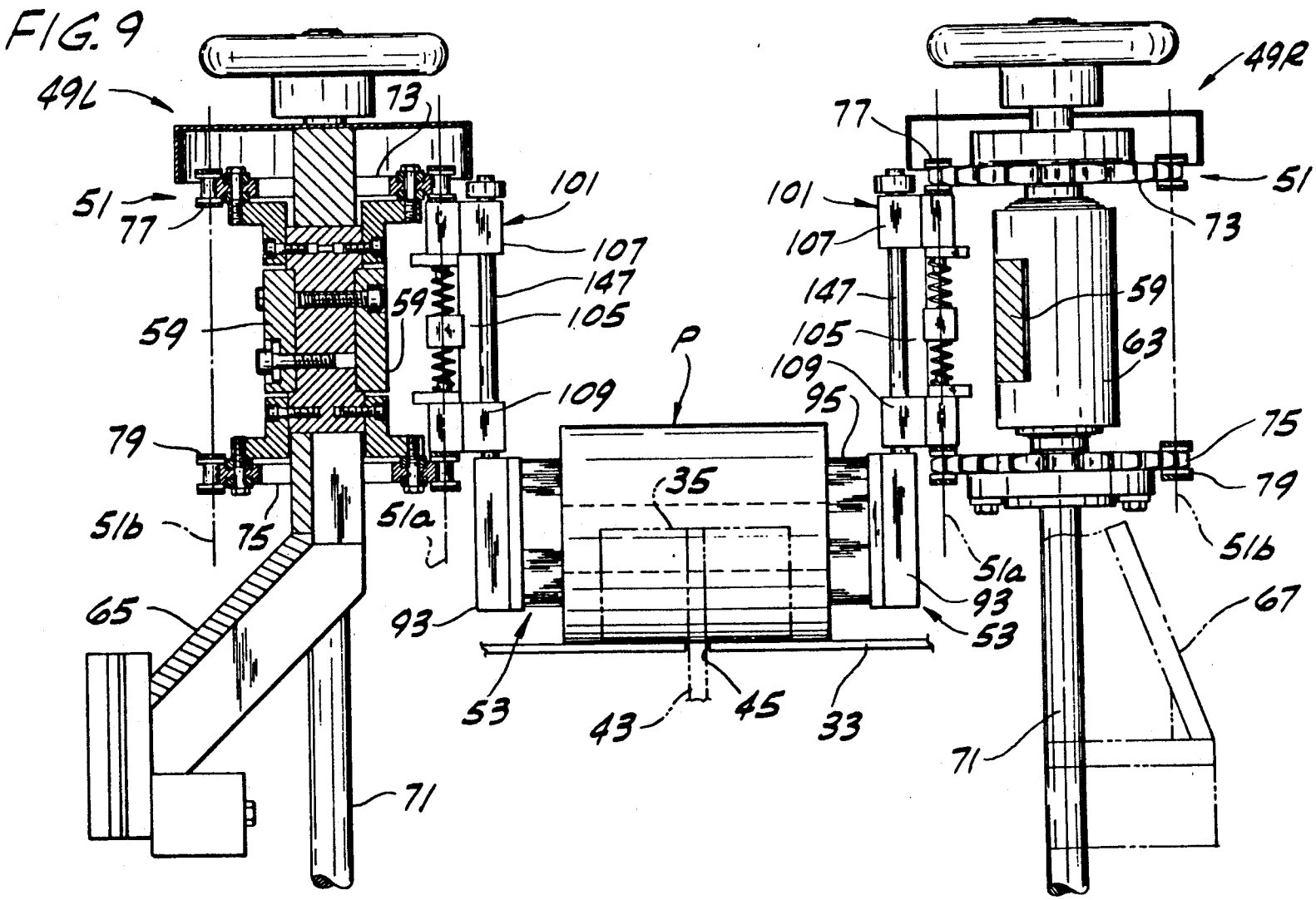
FIG. 9 is vertical transverse section generally on line 9—9 of FIG. 8.

The endless conveyor 51 of each of the units 49L, 49R comprises a relatively short beam 59 mounted in position extending horizontally at the respective side (left or right) of the path, more precisely at a level somewhat above the level of the path, along which the packages P are fed forward by the conveyor 31. Each beam 59 has a vertical bearing 61 at one end thereof, namely, its trailing or rearward end in respect to the direction of travel of the packages P and a vertical bearing 63 at its other end, which is its leading or forward end in respect to the direction of travel of the packages. The beam 59 of the left-hand unit 49L is mounted as shown in FIG. 9 on a pedestal 65 at the left side and the beam 59 of the right-hand unit 45R is mounted on a pedestal 67 at the right side. One of these pedestals is fixed. The other is suitably mounted for adjustment in and out toward and away from the package path for handling packages of different length. Shafts 69 and 71 are journalled in the bearings 61 and 63, respectively, each shaft having a sprocket 73 at its upper end and a sprocket 75 at its lower end. A chain 77 is trained around the upper sprockets 73 and a chain 79 is trained around the lower sprockets 75. The upper and lower sprockets are of equal diameter, and thus the chains have inner reaches travelling one above the other in a vertical plane delineating the inside reach 51*a* of the endless conveyor 51 and outer reaches travelling one above the other in a vertical plane constituting the outer return reach 51*b* of the endless conveyor 51. Each of the chains comprises a series of links 81*a* and 81*b* pivotally interconnected by tubular pivot pins 83. Backups for the inner and outer reaches of the chains are indicated at 85 and 87, respectively. The chains 77, 79 are driven in timed relation to the chain 37 of the package conveyor 31 by a drive such as indicated at 80 in FIGS. 6 and 8 connected to shaft 71.

Figure 10:
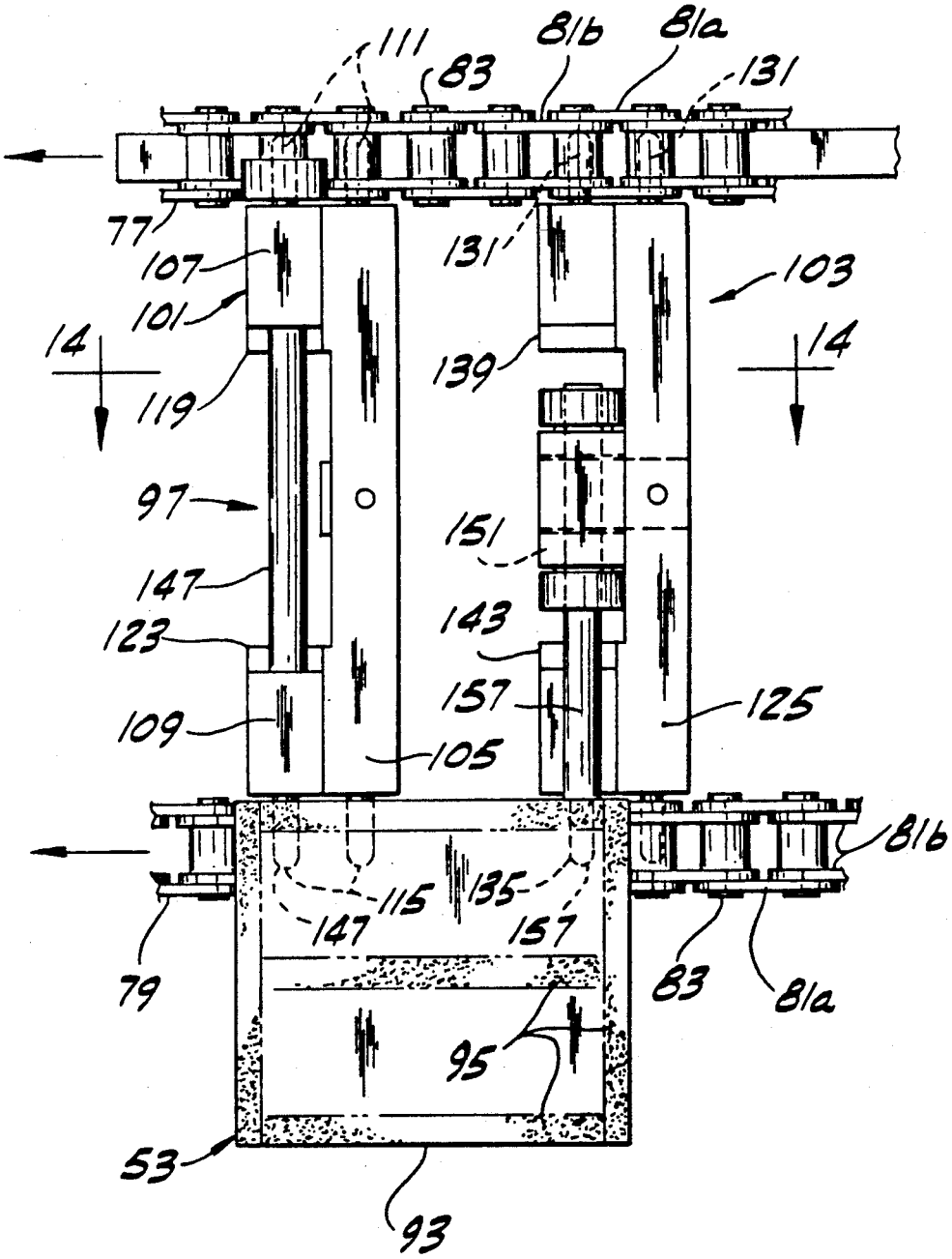
FIG. 10 is a view generally on line 10—10 of FIG. 8.
Figure 11:
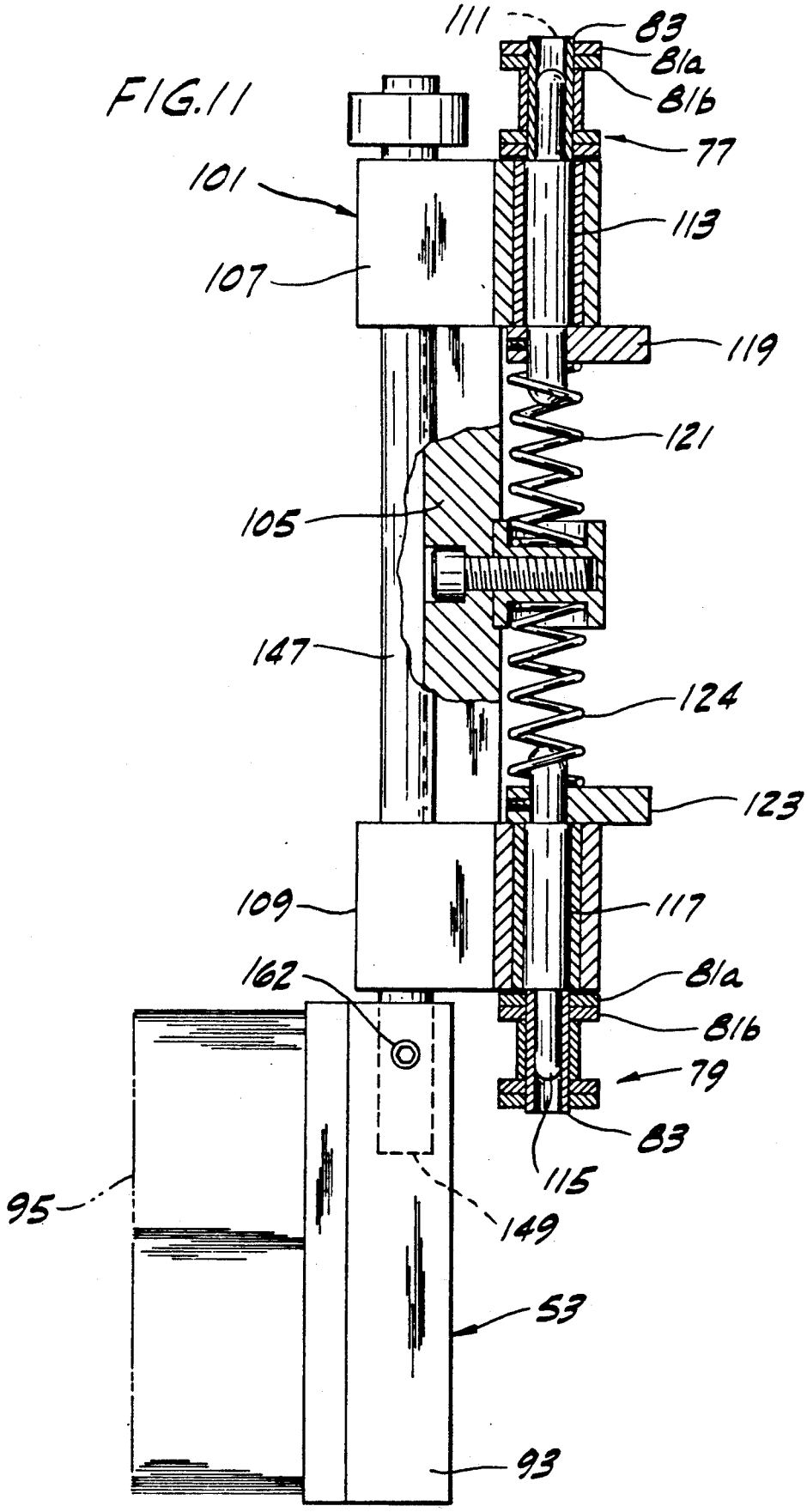
FIG. 11 is a view in elevation from the right of FIG. 10 with parts broken away and shown in section, and showing certain pins in their extended position in certain tubular pins which interconnect certain chain links of the FIG. 7 apparatus.
Figure 12:
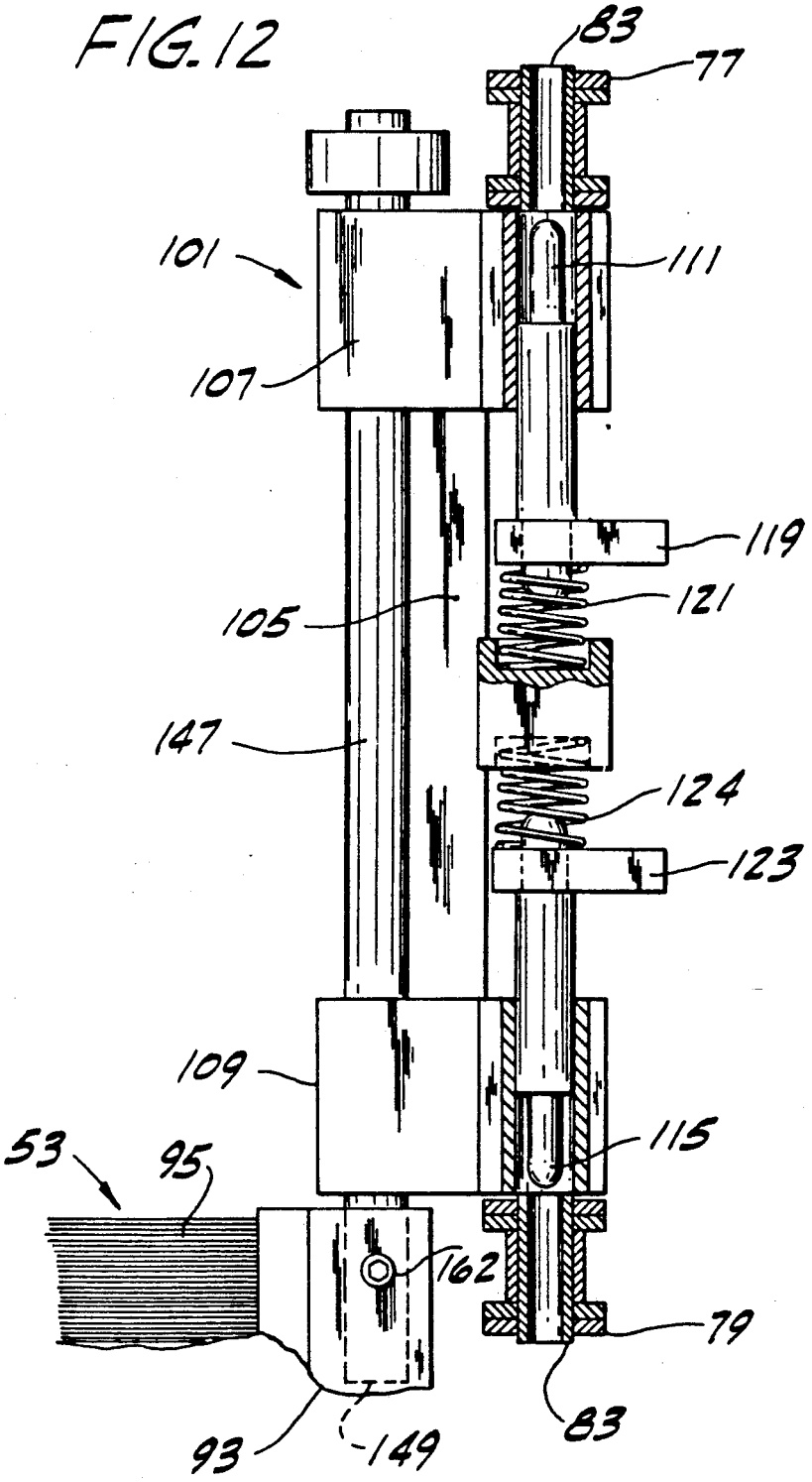
FIG. 12 is a view similar to FIG. 11 showing the first-mentioned pins retracted from the chains.
Figure 13:
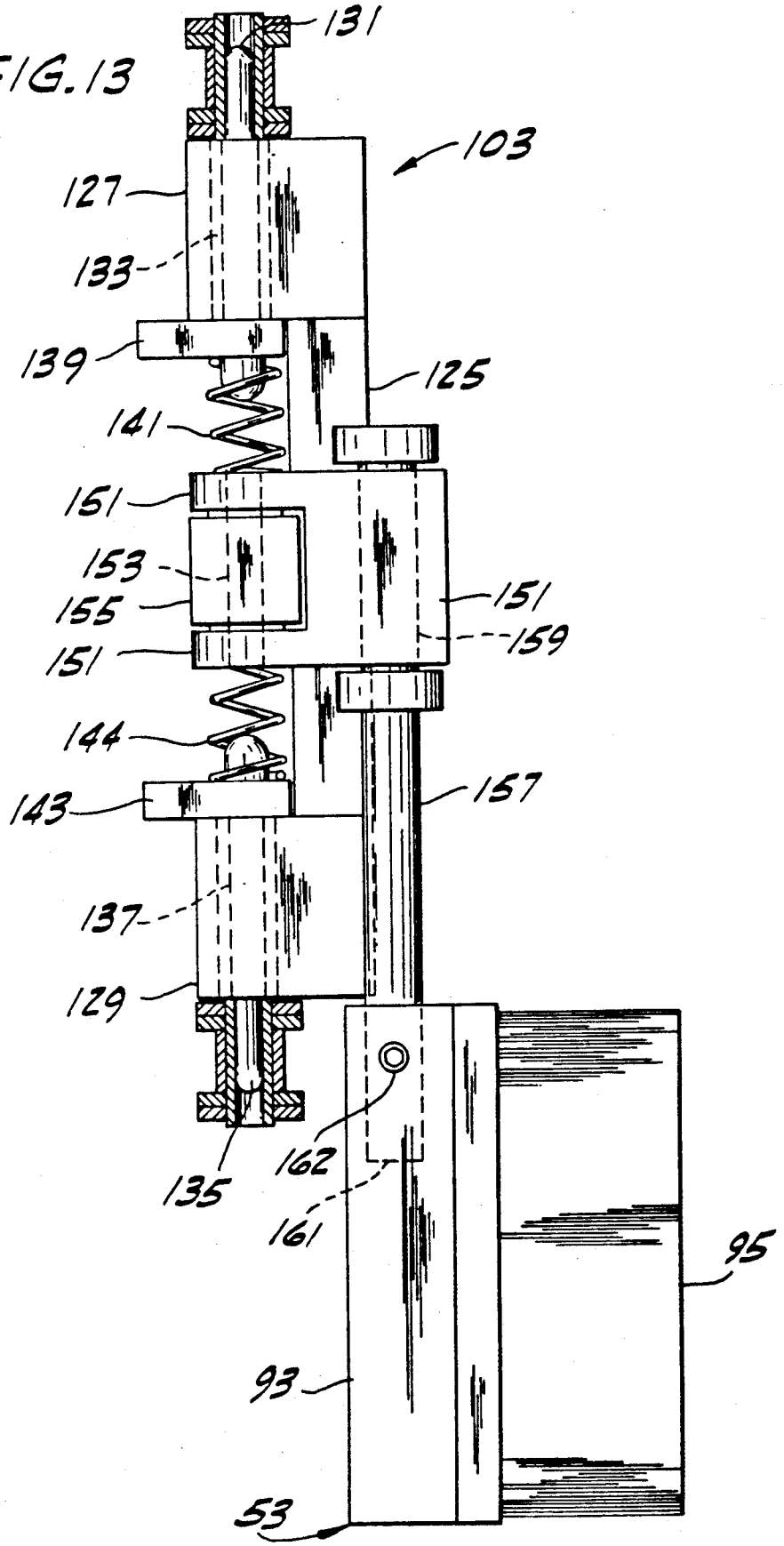
FIG. 13 is a view generally in elevation from the left of FIG. 10 with parts broken away and shown in section.

As herein illustrated, for operation on packages which comprise a unit or set of two rolls of toilet tissue arranged side by side in a wrapper extending beyond both ends of the set of rolls (which is called a 1×2×1 arrangement), each of the aforesaid flexible folding or tucking units 49L, 49R includes a single flexible folding member or tucker 53 constituted by a brush adapted to brush or "wipe" over the respective second (rear) end flap F3, this brush comprising a rectangular back 93 having a pattern of bristles 95 on one face thereof, which pattern may be as shown in FIG. 10. The brush 53 is carried by means generally designated 97 removably pinned in the upper and lower chains 77, 79 for movement of the brush with the chains and for movement of the brush relative to the chains with a special motion to be described. The carrier means 97 for the brush comprises a pair of brackets 101 and 103 extending vertically between the upper chain 77 and the lower chain 77, the brackets being spaced from one another along the length of the chains and being movable with the chains in the direction of chain movement. Each brush travels in an endless path in a horizontal plane at the level of the horizontal path of travel of the packages P.

The first bracket 101, which is the leading bracket of the two brackets in relation to the direction of movement of the chains, comprises a bar 105 which extends vertically between the chains having a head 107 projecting laterally at its upper end and a foot 109 projecting laterally at its lower end. Two pins each designated 111 are vertically slidable in holes 113 in the head between a raised extended position entered in two adjacent tubular pins 83 of the upper chain 77 for the removable attachment of the bracket at its upper end to the upper chain, and two pins each designated 115 are vertically slidable in holes 117 in the foot between a lower extended position entered in two adjacent tubular pins 83 of the lower chain for the removable attachment of the bracket at its lower end to the lower chain 79. The upper pins 111 extend up from a finger tab 119 by means of which they may be moved down to a retracted position withdrawn from the tubular chain pins 83 of the upper chain against the upward bias of a spring 121 (which biases the tab upwardly toward the bottom of the head 107). The lower pins 115 extend down from a finger tab 123 by means of which they may be moved up to a retracted position withdrawn from the tubular chain pins 83 of the lower chain against the downward bias of a spring 124 (which biases the tab 123 downwardly toward the top of the foot).

The second bracket 103, which is the trailing bracket of the two brackets in relation to the direction of movement of the chains, comprises a bar 125 which extends vertically between the chains having a head 127 projecting laterally at its upper end and a foot 129 projecting laterally at its lower end. Two pins each designated 131 are vertically slidable in holes 133 in the head between a raised extended position entered in two adjacent tubular pins 83 of the upper chain 77 for the removable attachment of the bracket 103 at its upper end to the upper chain, and two pins each designated 135 are vertically slidable in holes 137 in the foot between a lower extended position entered in two adjacent tubular pins 83 of the lower chain 79 for the removable attachment of the bracket 103 at its lower end to the lower chain. The upper pins 131 extend up from a finger tab 139 by means of which they may be moved down to a retracted position withdrawn from the tubular chain pins 83 against the upward bias of a spring 141 (which biases the tab upwardly toward the bottom of the head 127. The lower pins 135 extend down from a finger tab 143 by means of which they may be moved up to a retracted position withdrawn from the tubular chain pins 83 of the lower chain against the downward bias of a spring 144 (which biases the tab 143 downwardly toward the top for the foot 129.

A shaft 147 journalled in the head 107 and foot 109 of the stated first or leading bracket 101 extends vertically downward from the bracket into a hole 149 in the back 93 of the brush 53 adjacent the leading end of the brush (the leading end in relation to the movement of the brush with the chains 77, 79) for pivoting the brush for swinging movement about the vertical axis of the shaft. A crank arm 151 in the form of a yoke is pivotally mounted as indicated at 153 on a block 155 on the bar 125 of the stated second or trailing bracket 103 for swinging movement of the yoke relative to the bracket on a vertical axis. A shaft 157 journalled at its upper end in the yoke 151 as indicated at 159 extends vertically downward from the yoke into a hole 161 in the back of the brush adjacent the trailing end of the brush. The lower ends of the shafts 147 and 157 are secured as by set screws 162 in the back of the brush, the upper end of shaft 147 being rotatable in the bracket 101, the upper end of the shaft 157 being rotatable in the yoke 151 (which is pivoted at 153 on the bracket 153).

Figure 14:
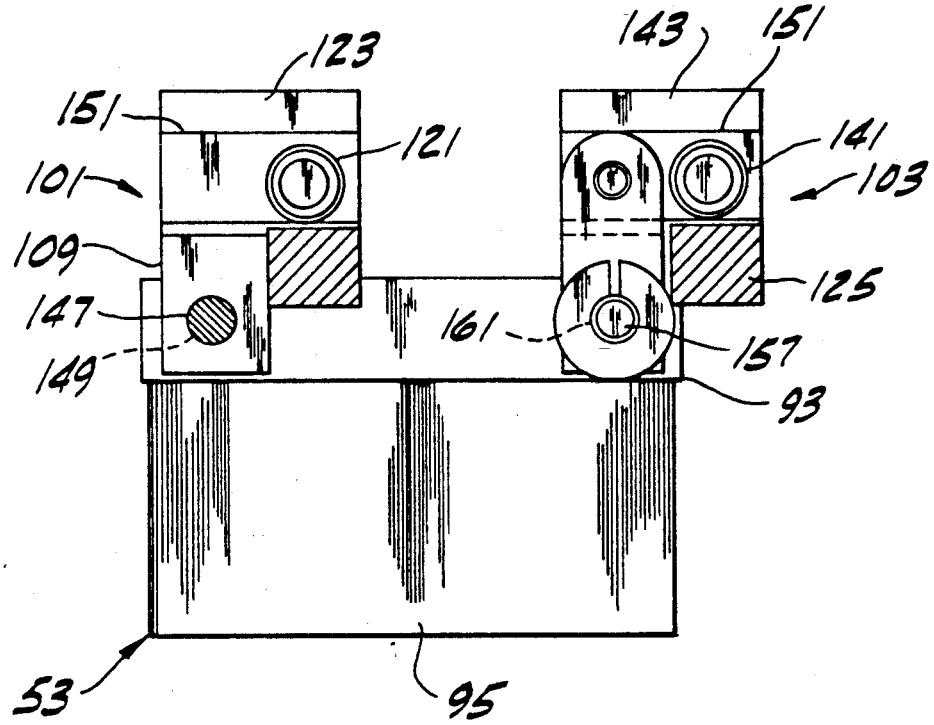
FIG. 14 is a view in horizontal section generally one line 14—14 of FIG. 10.
Figure 16:
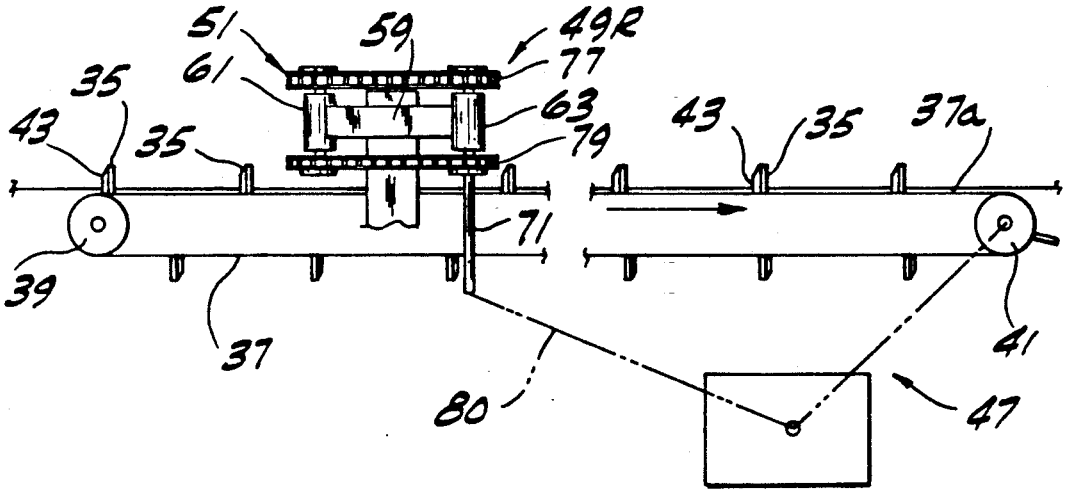
FIG. 16 is a semidiagrammatic view of certain conveyor means of the apparatus and the driving means therefor. Corresponding reference characters indicate corresponding parts throughout the several views of the drawings.
Figure 15:
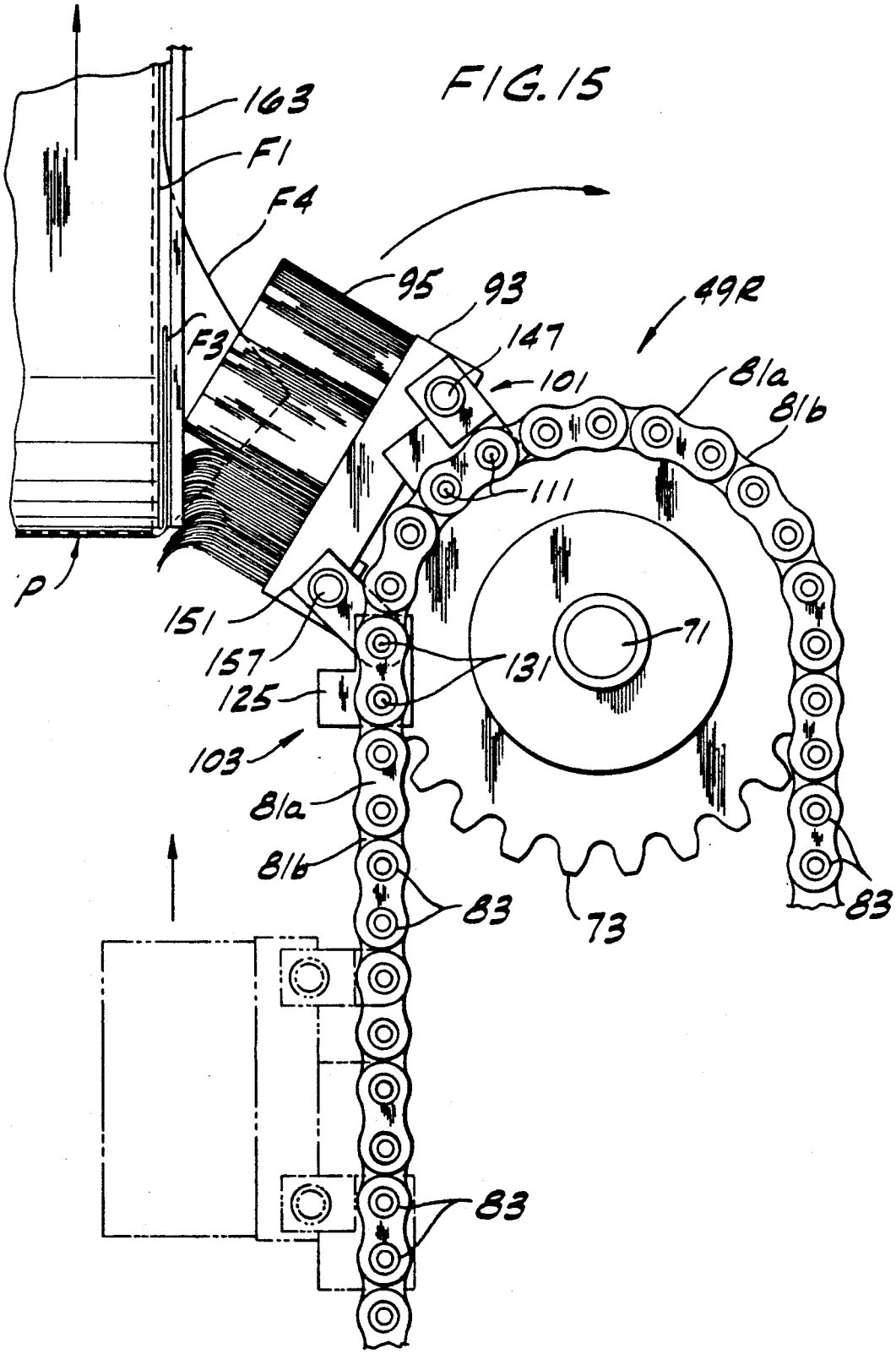
FIG. 15 is an enlarged fragment of FIG. 8 showing in phantom a first position of the flexible folding member (brush) and in solid lines a moved position.

The brush 53 is movable by and with the chains 77 and 79 in an endless path having straight inner and outer reaches parallel to the straight inner and outer reaches 51*a*, 51*b* of the chains. The arrangement is such that as the brush travels along the inner and outer reaches, it is held by the shafts 147 and 157 in a vertical position with its plane parallel to the inner and outer reaches, the yoke 151 occupying the position relative to bracket 103 in which it appears in FIG. 14 extending outwardly generally at right angles relative to the plane of the inner reach of the chains 77, 79. The arrangement is also such that the brush is adapted for swinging movement relative to the chains about the vertical pivot axis of the shaft 147 in the course of its travel with the chains 77, 79 as they travel around the sprockets 73, 75.

In the operation of the apparatus, chain 37 of conveyor 31 is continuously driven at a predetermined speed so related to the delivery of packages P by pulling means 29 of apparatus A (see also the aforesaid James U.S. Pat. No. 4,430,844), and in such timed relation to said delivery that each package issuing from apparatus A is delivered onto the table 33 in front of an oncoming flight 35 of conveyor 31. Each package is then continuously fed forward by said flight along the table in a predetermined horizontal path at the predetermined speed of the flight. The flights may be changed to accommodate packages of different lengths. The packages so fed forward extend transversely with respect to the direction of feed, with the free ends E of the wrapper 13 of each package extending laterally outwardly from the product unit 1 therein at opposite sides of the path.

As each package P is fed forward, it first passes through station A where top flaps F1 are folded over and down at both ends of the package and then through station B where the leading flaps F2 are folded back at both ends of the package, as previously described. The package then passes between the left-hand and right-hand folding or tucking units 49L, 49R at station C. The endless chain conveyor 51 of each of units 49L, 49R is continuously driven with chains 77 and 79 of the conveyor 51 of each unit 49L, 49R travelling at a speed higher than the speed at which the packages P are fed forward along the table 33. Travel of the brushes 53 of units 49L, 49R is so phased with respect to the travel of packages as the packages pass between units 49L, 49R that the brushes come around the rearward or trailing end 51*d* of the endless conveyors 51 of units 49L, 49R, and into the forward-traveling inner reaches 51*a* of their paths of travel after a package has progressed forward beyond the rearward or trailing ends of units 49L, 49R. The bristles of the brushes come into engagement with the trailing side 55 of the trailing portion 57 of each end of the wrapper 13 (which already has flaps F1 and F2 folded over), flex back as the brushes move linearly forward faster than the package, and fold or tuck over the trailing portion 57 of the ends of the wrapper on the ends of the set of rolls in the wrapper to form the rear end flaps F3. The brushes 53, in effect, wipe over the rear end flaps F3, substantially over the entire lengths of the end flaps from respective corners of the package toward the end edges of the flaps (see FIG. 8) the wiping action occurring as the package is moving forward by reason of the brushes moving forward at a higher speed than the package. As the brushes move forward in engagement with the rear end flap F3, they are in vertical position with their vertical endwise planes parallel to the straight inner reaches 51*a* of the conveyors 51. As the brushes 53 continue to move with the chains 77, 79 of the conveyors 51, bracket 101 for each chain starts travelling around in the forward end 51*c* of its path of travel with the chains around the forward sprockets 73,75. This change in direction from linear (straight-line) forward travel to arcuate outward travel results in each brush swinging relative to its respective set of chains 77, 79 about the vertical axis of the respective shaft 147 (carried by bracket 101) with accompanying swinging of the crank arm or yoke 51 to a position such as illustrated at the left upper portion of FIG. 8 and in FIG. 9. The net result of this is that as each brush is moved laterally outwardly and forwardly away from the folded-over rear end flap F3 as it moves around in the forward end reach of its endless path of travel, it is maintained in extended contact with the flap during the initial phase of this movement. This prolonged contact is advantageous in that it tends to prevent formation of ears and expedites the formation of neat end closures for the package. Once the rear end flaps F3 have been folded over, the package passes through station D where the bottom flaps F4 are folded up, as by plows such as indicated at 163 in FIG. 7. The packages with all four flaps F1–F4 at each end of each package folded up then pass through a sealing station where they are heat-sealed together in known manner, completing the wrapping of the set of rolls.

By the use of brushes with suitably flexible bristles, the apparatus is very forgiving of variations in the dimension of packages transversely of the conveyor (i.e. what may be referred to as the package length), and is adapted to allow the brushes to remain in contact with the folded-over flaps F3 right up to the point of overlapping with the plow 163.

For wrapping three-roll sets of toilet tissue in which the three rolls are disposed side-by-side, for example, the spacing of the flights 35 of the conveyor may change as, for example, by removing every other flight to double the flight spacing so as to accommodate the higher package width. The apparatus may also be used to package single rolls of paper toweling, for example, adjusting the lateral spacing of the left and right-hand units 49L, 49R to accommodate the greater length of the paper towel package in which case it may be desirable to mount a second brush 53 on each brush conveyor 51 spaced halfway around the conveyor from the one brush 53. In this regard, addition of the second brush may be easily and quickly effected simply by retracting the pins 111 and 115 of bracket 101 and the pins 131 and 135 of bracket 103, positioning the bracket between the upper and lower chains, and then releasing the pins to slide into respective tubular chain pins 83. And with the retractable pin mounting of the brackets, the brush carriers 97 are readily removable for repair and/or replacement.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. In the production of packages each comprising a unit of product having opposite ends and a flexible film wrapper wrapped around the unit, the wrapper initially being wider than the length of the unit from end-to-end and initially extending outwardly beyond at least one of the ends of the unit to form four closure flaps overlying said end, a first flap constituting a first side flap, a second flap constituting a first end flap, a third flap constituting a second end flap, and a fourth flap constituting a second side flap, the method of folding over the second end flap comprising:

continuously feeding packages forward one after another in a predetermined path in a horizontal plane at a predetermined speed with the packages extending transversely with respect to the direction of feed and with a trailing portion of the extending end of the wrapper extending laterally outwardly at one side of said path, and with the packages spaced at intervals along said path, and, as the packages are so fed forward, moving a yieldable folding member in said horizontal plane laterally inwardly and forwardly into yielding engagement with the trailing side of said trailing portion of the extending end of the wrapper of each package, and moving said yieldable folding member linearly forward in said horizontal plane in the direction of movement of the package at a higher speed than the speed of the package to fold over said trailing portion on said end of the product to form said second end flap, and then moving said yieldable folding member forwardly and laterally outwardly in said horizontal plane away from said folded-over second end flap, said linearly forward movement of said yieldable folding member being in a straight-line path generally parallel to the direction of package movement for a distance at least equal to the length of said second end flap as measured from the trailing side of said trailing portion of the extending end of the wrapper to the end edge of the second end flap, the yieldable folding member maintaining contact with the second end flap to wipe the second end flap against said end of the product during at least said linearly forward movement substantially over the entire length of the second end flap from a corner of the package toward said end edge of the second end flap.

2. The method of claim 1 wherein the yieldable folding member is maintained in part in yielding contact with the folded-over second end flap as it moves forwardly and laterally outwardly in said horizontal plane away from the folded-over second end flap.

3. The method of claim 1 wherein the wrapper initially extends outwardly beyond both ends of the product, each end of the wrapper being folded over to form said four closure flaps at each end of the unit, the packages being fed forward with a trailing portion of each extending end of the wrapper extending laterally outwardly at each side of said path, and wherein a yieldable folding member is moved in said horizontal plane laterally inwardly and forwardly into yielding engagement with said trailing portion of each extending end of the wrapper, and each yieldable folding member is moved linearly forward in said horizontal plane in the direction of movement of the package at said higher speed to fold over said trailing portions on each end of the unit to form said second end flap at each end, and both yieldable folding members are then moved forwardly and laterally outwardly in said horizontal plane away from the folded-over second end flaps.

4. The method of claim 3 wherein each folding member comprises a brush which is moved in an endless path in said horizontal plane having an inner straight horizontal reach wherein the brush moves forward, an outer return horizontal reach wherein the brush moves rearward, a horizontal forward end reach wherein the brush moves around from the inner reach to the return reach, and a horizontal rearward end reach wherein the brush moves around from the outer return reach to the inner reach, and wherein each brush is moved relative to said endless path as it moves around in said forward end reach in such a manner that part of the brush is maintained in contact with the respective folded-over second end flap during an initial portion of the movement of the brush around in said forward end reach, said inner straight horizontal reach having a length at least equal to the length of said second end flap as measured from the trailing side of said trailing portion of the extending end of the wrapper to the end edge of the second end flap.

5. The method of claim 4 wherein each brush has a leading end and a trailing end in respect to its direction of movement and is swung about a vertical axis adjacent its leading end as it moves around in said forward end reach in such manner that the trailing end portion of the brush is maintained in contact with the respective folded-over second end flap during said initial portion of the movement of the brush around in said forward end reach.

6. The method of claim 4 wherein said inner straight horizontal reach has a length of at least equal to the overall length of the end of a package.

7. The method of claim 1 wherein said linearly forward movement of said yieldable folding member is in a straight-line path for a distance at least equal to the overall length of the end of a package.

8. In apparatus for the production of packages each comprising a unit of product having opposite ends and a flexible film wrapper wrapped around the unit, the wrapper initially being wider than the length of the unit from end-to-end and initially extending outwardly beyond at least one of the ends of the unit, production of the packages comprising folding over said end of the wrapper on said end of the unit to form four closure flaps overlying said end, a first flap constituting a first side flap, a second flap constituting a first end flap, a third flap constituting a second end flap, and a fourth flap constituting a second side flap, means for folding over the second end flap comprising:

means for continuously feeding packages forward one after another in a predetermined path in a horizontal plane at a predetermined speed with the packages extending transversely with respect to the direction of feed and with a trailing portion of the extending end of the wrapper extending laterally outwardly at one side of said path, and with the packages spaced at intervals along said path;

a yieldable folding member, and means operable as the packages are so fed forward for moving the yieldable folding member in said horizontal plane laterally inwardly and forward into yielding engagement with the trailing side of each package, and moving said yieldable folding member linearly forward in said horizontal plane in the direction of movement of the package at a higher speed than the speed of the package to fold over said trailing portion on said end of the product to form said second end flap, and then moving said yieldable folding member forwardly and laterally outwardly in said horizontal plane away from said folded-over second end flap, said linearly forward movement of said yieldable folding member being in a straight-line path generally parallel to the direction of package movement for a distance at least equal to the length of said second end flap as measured from the trailing side of said trailing portion of the extending end of the wrapper to the end edge of the second end flap, and for maintaining the yieldable folding member in contact with the second end flap to wipe the second end flap against said end of the product during at least said linearly forward movement substantially over the entire length of the second end flap from a corner of the package toward said end edge of the second end flap.

9. In apparatus as set forth in claim 8, the yieldable folding member comprising a brush, the means for moving the brush being operable to move it laterally inwardly and forwardly for engagement of its bristles with the trailing side of said trailing portion of the extending end of the wrapper, then to move it linearly forward, and then to move it forwardly and laterally outwardly away from the folded-over second end flap, the means for moving the brush including means for maintaining it in part in yielding contact with the folded-over second end flap as it moves forwardly and laterally outwardly away from the folded-over second end flap.

10. In apparatus as set forth in claim 8 for the production of packages each having a wrapper which initially extends outwardly beyond both ends of the product, each end of the wrapper being folded over to form said four closure flaps at each end of the unit, the packages being fed forward in said horizontal plane with a trailing portion of each extending end of the wrapper extending laterally outwardly at each side of said path, said apparatus having a yieldable folding member for each end of the wrapper, and means operable as the packages are fed forward for moving each yieldable folding member in said horizontal plane laterally inwardly and forwardly into yielding engagement with said trailing portion of each extending end of the wrapper, and each yieldable folding member is moved linearly forward in said horizontal plane in the direction of movement of the package at said higher speed to fold over said trailing portions on each end of the unit to form said second end flap at each end, and both yieldable folding members are then moved forwardly and laterally outwardly in said horizontal plane away from the folded-over second end flaps.

11. In apparatus as set forth in claim 10, each yieldable folding member comprising a brush, the means for moving each brush comprising an endless conveyor having an inner straight reach wherein the brush moves forward in said horizontal plane, an outer return reach wherein the brush moves rearward in said horizontal plane, a forward end reach wherein the brush moves around from the inner reach to the outer reach in said horizontal plane, and a rearward end reach wherein the brush moves around from the outer return reach to the inner reach in said horizontal plane, and means mounted on each brush conveyor carrying the respective brush for movement relative to the endless path of said conveyor as the brush moves around in said forward end reach in such manner that part of the brush is maintained in contact with the respective fold-over second end flap during an initial portion of the movement of the brush around in said forward end reach, said inner straight horizontal reach having a length at least equal to the length of said second end flap as measured from the trailing side of said trailing portion of the extending end of the wrapper to the end edge of the second end flap.

12. In apparatus as set forth in claim 11, the carrying means for each brush being removably mounted on the respective conveyor.

13. In apparatus as set forth in claim 11, each brush having a leading end and a trailing end in respect to its direction of movement, said carrying means for each brush comprising first and second brackets mounted on the conveyor, the first leading the second, means pivotally mounting the brush on the first bracket for swinging movement about a vertical axis adjacent its leading end, an arm pivotally mounted on the second bracket for swinging movement about a vertical axis, and means pivotally mounting the brush on the arm for swinging movement about a vertical axis adjacent the trailing end of the folding member.

14. In apparatus as set forth in claim 13, each bracket being removably mounted on the respective conveyor.

15. In apparatus as set forth in claim 14, each brush conveyor being a chain conveyor having an upper chain and a lower chain, each chain comprising links interconnected by tubular pins, each bracket having a set of pins at its upper end retractably entered in tubular pins of the upper chain and a set of pins at its lower end retractably entered in tubular pins of the lower chain.

16. An apparatus as set forth in claim 11 wherein said inner straight horizontal reach has a length at least equal to the overall length of the end of a package.

17. An apparatus as set forth in claim 8 wherein said linearly forward movement of said yieldable folding member is in a straight-line path for a distance at least equal to the overall length of the end of a package.

* * * * *